US007429198B1

(12) United States Patent
Baxter et al.

(10) Patent No.: US 7,429,198 B1
(45) Date of Patent: Sep. 30, 2008

(54) ELECTRODE CONNECTOR FOR RING LASER GYROS

(75) Inventors: James K. Baxter, Saint Paul, MN (US); Robert M. Bowman, Plymouth, MN (US); Kenneth W. Lillemo, Shoreview, MN (US); Lloyd C. Meissner, Rogers, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/760,630

(22) Filed: Jun. 8, 2007

(51) Int. Cl.
*H01R 13/33* (2006.01)

(52) U.S. Cl. ..... 439/840; 454/74; 137/466

(58) Field of Classification Search ..... 439/840; 454/74; 137/486, 489
See application file for complete search history.

(56) References Cited

U.S. PATENT DOCUMENTS 4,506,594 A * 3/1985 Rowland et al. ..... 454/74
2004/0027217 A1* 2/2004 Fujita et al. ..... 335/2

* cited by examiner

*Primary Examiner*—Jean F Duverne
(74) *Attorney, Agent, or Firm*—Black Lowe & Graham

(57) ABSTRACT

A laser block assembly (LBA) gas fill process device with improved cathode electrode connectors. An example device includes a gas fill component that attaches to an LBA under test and electrical connectors that receive a voltage bias from a voltage source and apply the voltage bias to cathodes of the LBA. The electrical connectors include an end having a torsion spring that is sized based on the cathodes of the LBA. Also, the electrical connectors may include a strain relief spring.

13 Claims, 2 Drawing Sheets

ELECTRODE CONNECTOR FOR RING LASER GYROS

BACKGROUND OF THE INVENTION

When a laser block assembly (LBA), such as LBA-1308 produced by Honeywell International Inc., is mounted to a gas fill process device, a voltage source is applied to cathodes of the LBA. FIG. 1 illustrates a ceramic plate device that is mounted onto the LBA. The ceramic plate device includes metallic loops that make an electrical contact with the cathodes of the LBA. Wires that connect the loops to the voltage source are attached to a second side of this ceramic plate and are bonded to the loops within the plate. After an LBA is mounted to a fill device, the ceramic block is placed on the LBA. After the fill process is complete, the ceramic plate is returned to a storage position. Because of both the high temperatures employed and the manipulation required mounting and demounting leadwires of the connector, assemblies have a tendency to fail prematurely. In addition, the brittle ceramic plate is subject to damage over the course of normal use.

SUMMARY OF THE INVENTION

The present invention provides a laser block assembly (LBA) gas fill process device with improved cathode electrode connectors. An example device includes a gas fill component that attaches to an LBA under test and electrical connectors that receive a voltage bias from a voltage source and apply the voltage bias to cathodes of the LBA. The electrical connectors include an end having a torsion spring that is sized based on the cathodes of the LBA.

In one aspect of the invention, the electrical connectors include a strain relief spring.

In another aspect of the invention, a seat located adjacent to the gas fill component slideably receives the electrical connectors.

In still another aspect of the invention, the electrical connectors include a heat resistive sheathing. The heat resistive sheathing may be a colored sheathing.

In still further aspects of the invention, the torsion springs have an inside diameter that is smaller than a diameter of the cathodes.

In yet another aspect of the invention, the lead exits of the torsion springs are selected to be outboard from the LBA to reduce or eliminate damage to fragile or electrically sensitive features.

In further aspects of the invention, the torsion spring transitions to a smaller than nominal diameter to provide a "stop" limiting axial engagement. The limited axial engagement allows for easy removal and reduces or eliminates damage to fragile features.

In additional aspects of the invention, the method for installation includes simultaneous rotation and axial force application on the torsion spring. Rotation is in a direction unwinding the coil.

In yet other aspects of the invention, the wire material is selected to incorporate nickel plated stainless steel to reduce oxidation, electrical contact resistance and embrittlement in a high temperature or other oxidizing environment.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
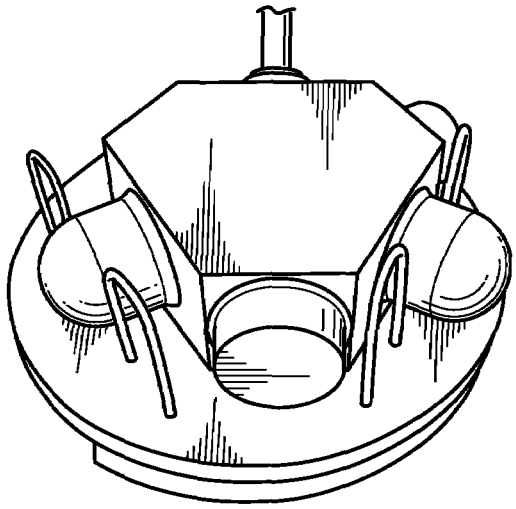
FIG.1 (PRIOR ART)
FIG. 1 illustrates a perspective view of a device formed in accordance with the prior art.
Figure 2:
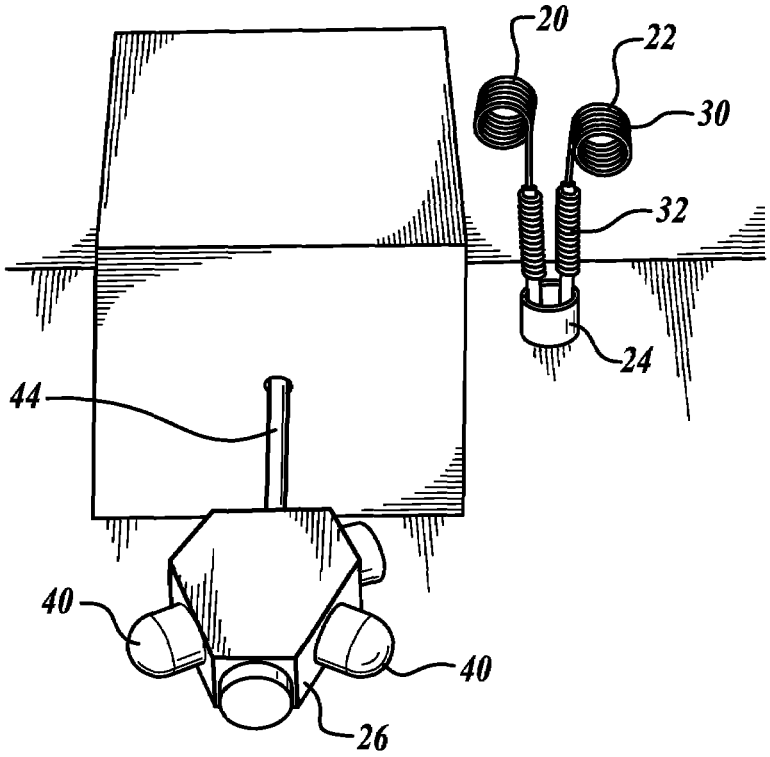
FIGS. 2-4 illustrate perspective views of attachment devices formed in accordance with an embodiment of the present invention.
Figure 3:
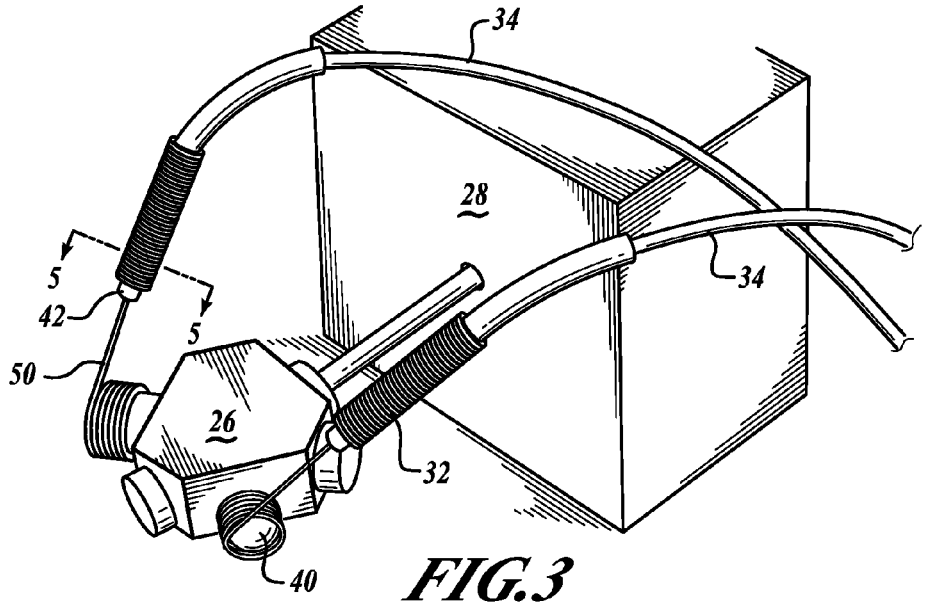
Figure 4:
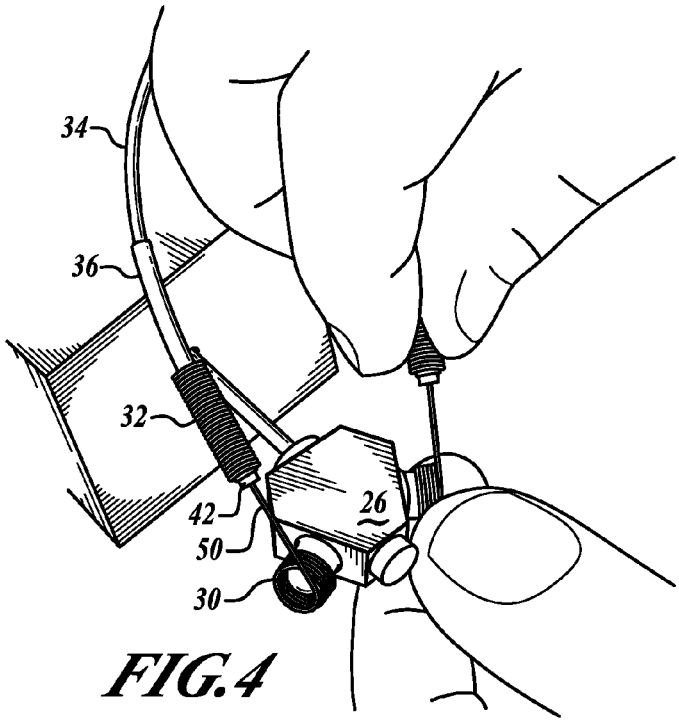

FIGS. 2-4 illustrate perspective views of a portion of a gas fill process device 28 having a laser block assembly (LBA) 26 mounted thereto. The device 28 includes torsional electrode connectors 20, 22 that are received in a storage seat 24 and are electrically connected to a voltage source (not shown) of the device 28. The device 28 includes one or more gas supply structures 44 that an LBA 26 is mounted to. The connectors 20, 22, the seat 24, and the structure 44 are included in a chamber that is heated according to predefined test condition parameters.

The seat is preferably made of a high temperature insulating material, such as aluminum oxide ceramic.

Before testing of the LBA 26 begins, the torsional electrode connectors 20, 22 are retrieved from a storage seat 24 and attached to cathodes (or electrodes) 40 of the LBA 26. Each of the torsional electrode connectors 20, 22 includes a first end having a torsion spring 30. The remaining portion of the connectors 20, 22 is almost entirely covered by a wire sheathing 36 for insulation. In one embodiment, the sheathings 34 are different colors for each of the connectors 20, 22 and are heat resistive.

The connectors 20, 22 also include a strain relief spring 32 that is located at an end of the connectors 20, 22 closest to the torsion spring 30. The strain relief spring 32 is twisted onto a crimp sleeve 34, which is first covered by the sheathing 36 (e.g. Teflon™ strain relief tubing)—see FIG. 5.

After the LBA 26 is mounted to the device 28, an operator retrieves one of the connectors 20, 22 from the storage seat 24. The operator attaches the torsion spring 30 to the desired cathode 40 by holding the torsion spring 30 with one hand and the non-coiled portion of the connectors 20, 22 or the strain relief spring 32 with the other hand and rotating the other hand in a direction opposite that of the direction that the torsion spring 30 is coiled in. At the same time, the operator lightly forces the torsion spring 30 onto the respective cathode 40. The diameter of the torsion spring 30 is slightly less than the diameter of the cathodes 40. As shown by the action in FIG. 4, an unwinding of the torsion spring 30 is performed. The torsion spring 30 is mounted onto the cathode 40 so that the torsion spring 30 is far enough onto the cathode 40 to provide adequate grip and an electrical connection, but not so far as to disrupt the frit bond between the cathode 40 and the LBA 26. The non-coiled portion of the connectors 20,22 are configured at the outboard end of the electrode 40 to eliminate damage to fragile and electrically sensitive features.

After testing has occurred, the operator then removes the connectors 20, 22. This is done by the operator gripping the connectors 20, 22 and slightly unwinding the torsion spring 30 in order to relieve gripping pressure on the respective cathode 40. Once pressure has been relieved, the torsion spring 30 is removed from the cathode 40 and the connector 20, 22 is replaced into the storage seat 24.

In one embodiment, the connectors 20, 22 are a 22 gauge wire, but may be of any gauge that allows for strength and flexibility to withstand the heat and physical cycling associated LBA testing.

Figure 5:
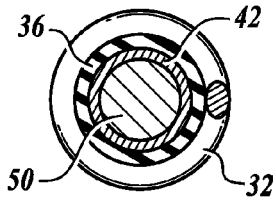
FIG. 5 is a cross-sectional view of a straight portion of a connector (lead).

FIG. 5 is a cross-sectional view of a straight portion of a connector 20, 22 (lead). The connectors 20, 22 includes a straight portion 50. At a section of the straight portion 50 proximate to the torsion spring 30, the connector 20, 22 is covered by the crimp sleeve 34, which is covered by the sheathing 36 and then by the strain relief spring 32.

In another embodiment, the electrodes may include an internal cavity and the torsion spring is designed to be able to fit inside the cavity. The torsion spring is rotated under pressure to a size that less than the diameter or width of the cavity. When pressure is released the spring expands to put pressure on the walls of the cavity thereby making a good electrical contact.

While the preferred embodiment of the invention has been illustrated and described, as noted above, many changes can be made without departing from the spirit and scope of the invention. For example, the connectors 20, 22 with torsion spring 30 may vary in size/length depending upon the size of the cathodes of the LBAs being tested. Also, the connectors 20, 22 may be used within other systems for providing low strain electrical connections. Accordingly, the scope of the invention is not limited by the disclosure of the preferred embodiment. Instead, the invention should be determined entirely by reference to the claims that follow.

The invention claimed is:

1. An electrical lead device comprising:

a straight portion being connected to an electrical source at one end; and a torsion spring formed at another end of the straight portion, wherein the electrical lead device is used in a laser block assembly (LBA) fill process device having a gas fill component configured to attach to an LBA under test, the device configured to apply a voltage bias from the electrical source to one or more electrodes of the LBA, wherein the torsion spring having a diameter and longitudinal length based on the one or more electrodes of the LBA.

2. The device of claim 1, wherein the electrical lead device comprises a strain relief device.

3. The device of claim 2, wherein the strain relief device comprises a strain relief spring.

4. The device of claim 3, further comprising:

a crimp sleeve configured to connect the straight portion to a flexible wire; and a flexible tubing covering a portion of the crimp sleeve, wherein a portion of the flexible tubing is located between the strain relief device and the crimp sleeve.

5. The device of claim 1, further comprising a seat being configured to slideably receive the at least one electrical connector.

6. The device of claim 1, wherein the electrical lead device comprises a heat resistive sheathing.

7. The device of claim 6, wherein the heat resistive sheathing is color coded.

8. The device of claim 1, wherein the torsion spring has a first portion having an inner diameter that is smaller than a diameter of the one or more electrodes.

9. The device of claim 8, wherein the straight portion is coiled at the other end to form the torsion spring, when mounted to the electrode the straight portion is located proximate to an end of the electrode that is furthest away from the LBA.

10. The device of claim 8, wherein the torsion spring coil comprises a second portion having an inner diameter that decreases from the inner diameter of the first portion to a predefined diameter.

11. The device of claim 1, further comprising nickel plated stainless steel.

12. The device of claim 1, wherein the connection is made to one or more electrical contacts.

13. The device of claim 12, wherein the torsion spring is configured to be able to be reduced in diameter for placement inside an electrical contact.

* * * * *